US006898876B2

(12) United States Patent
Kerrigan

(10) Patent No.: US 6,898,876 B2
(45) Date of Patent: May 31, 2005

(54) ZIPPED FOOTBALL BOOT

(75) Inventor: Anthony Kerrigan, 23 Stonyfield, Sefton, Liverpool (GB)

(73) Assignee: Anthony Kerrigan, Liverpool (GB)

( * ) Notice: Subject to any disclaimer, the term of this patent is extended or adjusted under 35 U.S.C. 154(b) by 55 days.

(21) Appl. No.: 10/601,422

(22) Filed: Jun. 23, 2003

(65) Prior Publication Data

US 2004/0088886 A1 May 13, 2004

Related U.S. Application Data

(60) Provisional application No. 60/394,816, filed on Jul. 11, 2002.

(51) Int. Cl.[7] ..... A43B 11/00
(52) U.S. Cl. ..... 36/138; 36/50.1; 36/54
(58) Field of Search ..... 36/136, 127, 128, 36/50.1, 50.5, 138, 54

(56) References Cited

U.S. PATENT DOCUMENTS

| | | | | | |
|---|---|---|---|---|---|
| 2,022,554 | A | * | 11/1935 | Williams | 36/54 |
| 2,345,057 | A | * | 3/1944 | Marinetti | 36/50.1 |
| 2,891,328 | A | * | 6/1959 | Volk | 36/50.1 |
| 3,310,889 | A | * | 3/1967 | Samuels | 36/72 R |
| 3,855,715 | A | * | 12/1974 | Johnson | 36/50.1 |
| 4,126,951 | A | * | 11/1978 | Antonious | 36/54 |
| 4,693,018 | A | * | 9/1987 | Maleyko et al. | 36/1.5 |
| 4,829,683 | A | * | 5/1989 | Chikamori et al. | 36/51 |
| 4,918,840 | A | * | 4/1990 | Nardulli | 36/50.1 |
| 6,701,640 | B2 | * | 3/2004 | Nakano | 36/8.1 |

* cited by examiner

*Primary Examiner*—Ted Kavanaugh

(57) ABSTRACT

A football boot with a zip replacing laces. Easy on/off capability and no time wasted due to tying and retying laces. No pressure point and also eliminates injury risk of players tripping over undone laces.

1 Claim, 3 Drawing Sheets

TOP VIEW: WITH TONGUE FOLDED BACK AND REFERENCE NUMBERS

ANGELD TOP VIEW OF BOOT
WITH TONGUE UP SHOWING ZIP CLOSURE

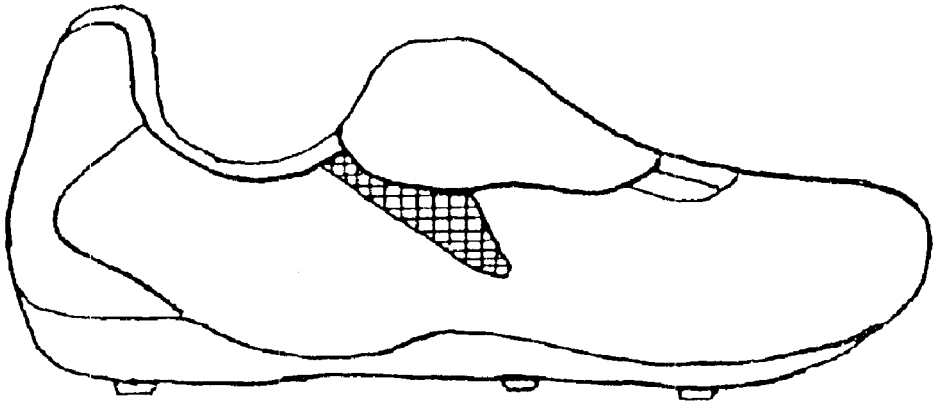
FIG 2 SIDE VIEW WITH TONGUE DOWN

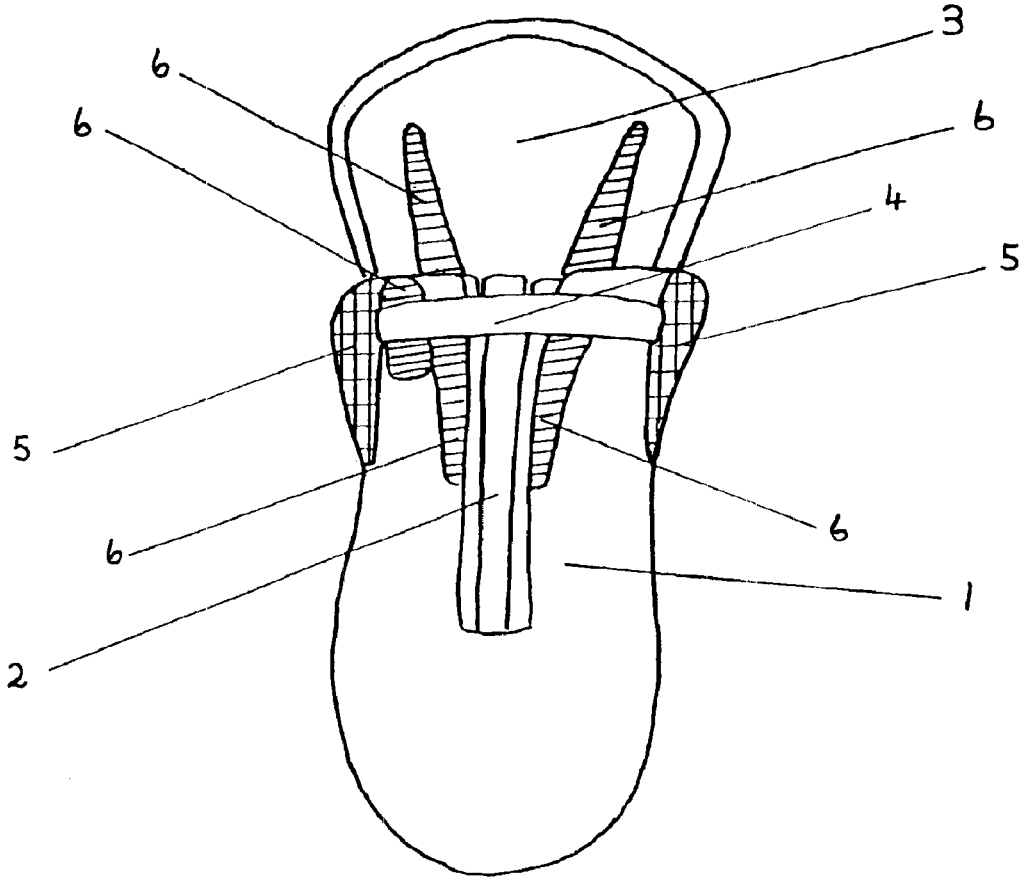
FIG 3 TOP VIEW: WITH TONGUE FOLDED BACK AND REFERENCE NUMBERS

ZIPPED FOOTBALL BOOT

This application claims benefit of provisional application No. 60/394,816 filed Jul. 11, 2002.

Relates to a concealed self covering zip, with elasticated support/fit replacing the lace in football boots. Football is now more popular than ever before. More and more children are talking up the sport at an early age. There has, however, been a problem with children in the age group of 5–10 year olds relacing up their footwear to play football in. Many children cannot lace/unlace their footwear. It becomes more of a problem if there is no adult present to assist them and even more exasperating in wet or cold weather. This can prevent problems for coaching staff/teachers as precious time is wasted tying/retying laces that become undone. This concept removes the problem and also provides additional benefits, easy on/off capability, no pressure point discomfort and eliminated injury risk of players tripping over undone laces.

BACKGROUND OF THE INVENTION

The invention relates to a football boot with a zip replacing the laces.

The football boot with laces is in worldwide use and worn by young and old alike but the lace itself has certain disadvantages.

Many children cannot lace or unlace their footwear. It becomes more of a problem If there is no adult present to assist them and even more exasperating in wet or cold weather. This can present problems for coaching staff or teachers as precious time is wasted tying and retying laces that have become undone. The latter is also a problem for teenagers and adults.

There is also the problem of the lace becoming knotted, being broken or stepping on untied laces.

BRIEF SUMMARY OF THE INVENTION

To replace the laces in football boots with a zip.

The object of this invention is to eliminate the problems and disadvantages of a laced football boot and allow both the young and old to be able to slip the football boot on and off with no problems.

This concept removes any previous problems and also provides additional benefits, easy on/off capability, no pressure point discomfort and eliminate injury risk of players tripping over undone laces.

Children would not need assistance to lace or unlace their boots and no time would be wasted due to laces becoming undone or knotted.

BRIEF DESCRIPTION OF THE DRAWINGS

FIG. 2. side view with tongue down.

FIG. 3. top view: with tongue folded back. and reference numbers.

REFERENCE NUMBERS

Figure 1:
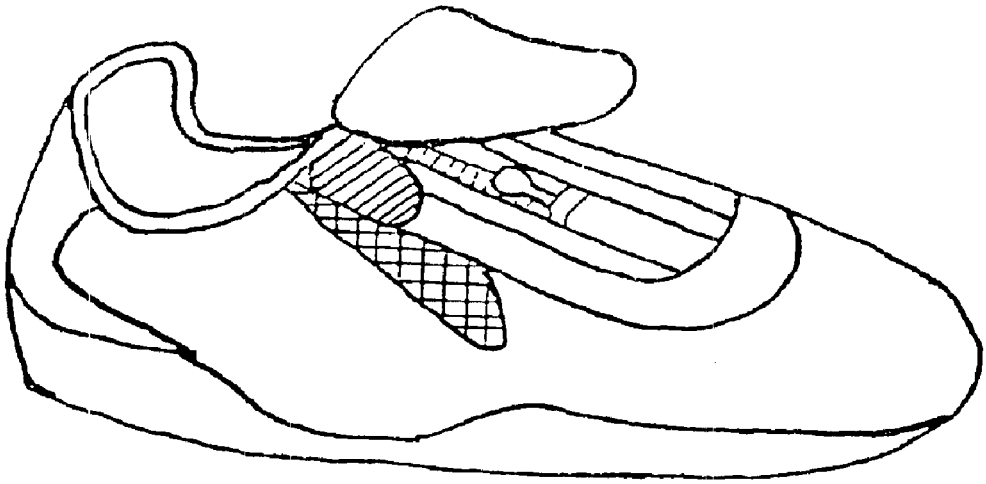
FIG. 1. angled top view of boot with tongue up showing zip closure.

No. 1: Boot
No. 2: Concealed Self Covering Zip Closure
No. 3: Under-Side Of Tongue
No. 4: Velcro Over Strap For Extra Securement
No. 5: Elastic Gusset
No. 6: Velcro

DETAILED DESCRIPTION OF THE INVENTION

The football boot consists of a concealed self covering zip closure—replacing laces.

A retainer strap over the zip—secured with velcro (hook and loop type fastener) to ensure zip remains closed.

An elastic gusset either side of boot—for width fitting comfort.

A velcro secured tongue with velcro either side to fold over the strap and cover zip closure for a smooth flat surface and to protect the zip.

I claim:

1. A shoe comprising a sole and an upper having a foot opening, wherein the upper further consist of:

a zipper type closure along an instep area of the upper, a pair of elastic gussets on a lateral and medial sides of the upper to provide width fitting comfort, a tongue having an extension extending beyond the opening of the upper wherein the extension has hook and loop type fastener on the underside thereof to fasten to a corresponding hook and loop type fastener on the upper, wherein the tongue folds over the instep area and is secured to the upper to conceals the zipper closure; and a retaining the extending over the zipper type closure and under the tongue extension.

* * * * *